United States Patent [19]

Kubota et al.

[11] Patent Number: 5,007,033

[45] Date of Patent: Apr. 9, 1991

[54] WORLD TIMEPIECE

[75] Inventors: Maki Kubota; Hideo Aso, both of Tokyo, Japan

[73] Assignee: Seikosha Co., Ltd., Japan

[21] Appl. No.: 285,002

[22] Filed: Dec. 15, 1988

[30] Foreign Application Priority Data

Dec. 21, 1987 [JP] Japan ..... 62-323585

[51] Int. Cl.[5] ..... G04B 19/22

[52] U.S. Cl. ..... 368/21

[58] Field of Search ..... 368/21-24

[56] References Cited

U.S. PATENT DOCUMENTS

| | | | |
|---|---|---|---|
| 3,940,920 | 3/1976 | Nakamura et al. | 368/21 |
| 4,217,653 | 8/1980 | Nakata | 368/21 |
| 4,274,151 | 6/1981 | Kamiwaki | 368/21 |
| 4,316,272 | 2/1982 | Naito | 368/21 |
| 4,681,460 | 7/1987 | Nishimura | 368/21 |

FOREIGN PATENT DOCUMENTS 56-150379 11/1981 Japan ..... 368/22

*Primary Examiner*—Vit W. Miska

*Attorney, Agent, or Firm*—Bruce L. Adams; Van C. Wilks

[57] ABSTRACT

A world timepiece for normally displaying the time of a home city and for selectively displaying the time of another city situated in another time zone. The world timepiece includes a plurality of selector switches corresponding to main cities located in different time-lag zones into which the world is divided. A display unit normally displays the time of the user's home city and, upon actuation of one of the selector switches, the display unit displays the time of the selected city designated by the actuated selector switch. A city of an arbitrary time-lag zone can be stored in an assigned city storage circuit, and the time of the assigned city can be displayed by the display unit by actuating an optional switch.

4 Claims, 5 Drawing Sheets

FIG. 3

| ZONE NUMBER | CITY NUMBER | MAIN CITY NAME | TIMELAG (HOUR) |
|---|---|---|---|
| 1 | 1 | HONOLULU | 1 |
| 2 | 2 | ANCHORAGE | 1 |
| 3 | 3 | LOS ANGELES | 1 |
| 4 | 4 | DENVER | 1 |
| 5 | 5 | CHICAGO | 1 |
| 6 | 6 | NEW YORK | 1 |
| 7 | — | CARACAS | 0.5 |
| 8 | — | CANADA | 0.5 |
| 9 | 7 | RIO DE JANEIRO | 1 |
| 10 | — | GREENLAND | 1 |
| 11 | — | AZORES | 1 |
| 12 | 8 | LONDON | 1 |
| 13 | 9 | PARIS | 1 |
| 14 | 10 | CAIRO | 1 |
| 15 | 11 | MOSCOW | 0.5 |

| ZONE NUMBER | CITY NUMBER | MAIN CITY NAME | TIMELAG (HOUR) |
|---|---|---|---|
| 16 | — | IRAN | 0.5 |
| 17 | 12 | DUBAI | 0.5 |
| 18 | — | AFGHANISTAN | 0.5 |
| 19 | 13 | KARACHI | 0.5 |
| 20 | 14 | NEW DELHI | 0.5 |
| 21 | — | DACCA | 0.5 |
| 22 | — | BURMA | 0.5 |
| 23 | 15 | BANGKOK | 1 |
| 24 | 16 | HONG KONG | 1 |
| 25 | 17 | TOKYO | 0.5 |
| 26 | — | ADELAIDE | 0.5 |
| 27 | 18 | SYDNEY | 1 |
| 28 | — | SOLOMON | 1 |
| 29 | 19 | WELLINGTON | 1 |
| 30 | — | SIBERIA | — |

WORLD TIMEPIECE

BACKGROUND OF THE INVENTION

The present invention relates to a world timepiece.

A prior art world timepiece for displaying the time of major cities of the world through changing selectively on one display unit includes a selector switch provided correspondingly to a main city of a desired zone out of a plurality of time-lag zones into which the world is divided accordingly, and the time of the desired city is displayed according to the operation of the selector switch.

In the aforementioned prior art, the time to be obtained is only that of a zone for which the selector switch is provided. Further, a large space is required for providing the selector switch correspondingly to each divided, zone, and such disadvantageous is from the standpoint of miniaturization and lightweight requirements for such type of timepiece. moreover, the selector switch provided for such zone as will almost not require time information may serve nothing, and hence is useless.

SUMMARY OF THE INVENTION

The invention is to provide a world timepiece whereby users may get the time of a city in a desired arbitrary zone simply on a few switches added thereto.

In a world timepiece for displaying the time of each main city on one display unit through changing selectively, the invention comprises dividing the world into a plurality of time-lag zones, providing an exclusive selector switch for the zone in which a normally required city is present, and providing an assigned city set switch for assigning the city of an arbitrary zone of those divided zones as and option, thereby selectively displaying the time of city of a desired zone.

BRIEF DESCRIPTION OF THE DRAWINGS

FIG. 3 is an explanatory drawing showing an example of zone division and others.

DETAILED DESCRIPTION OF THE INVENTION

The invention will now be described with reference to the accompanying drawings representing one embodiment thereof.

Figure 1:
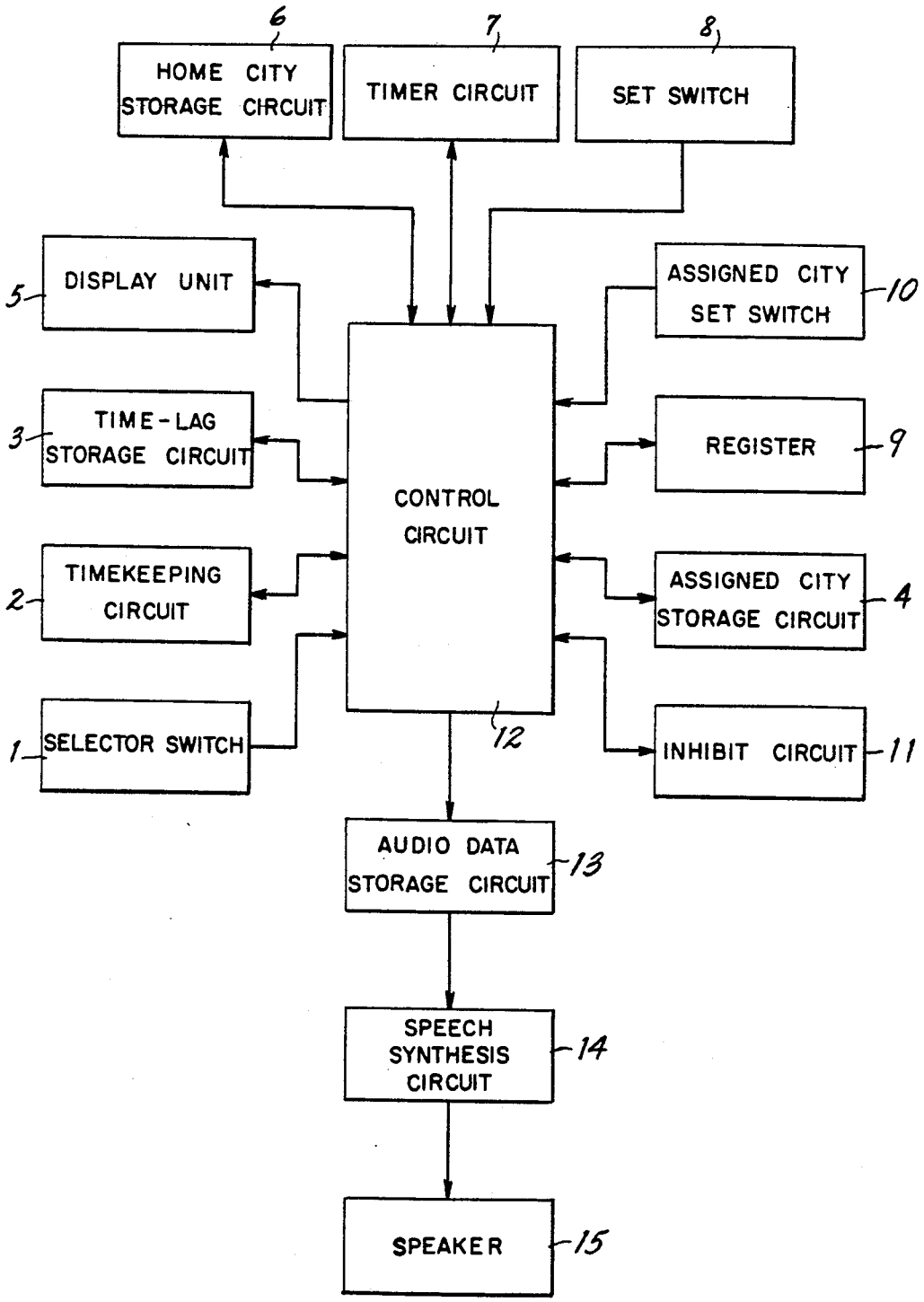
FIG. 1 is a block diagram representing one embodiment of the invention.
Figure 2:
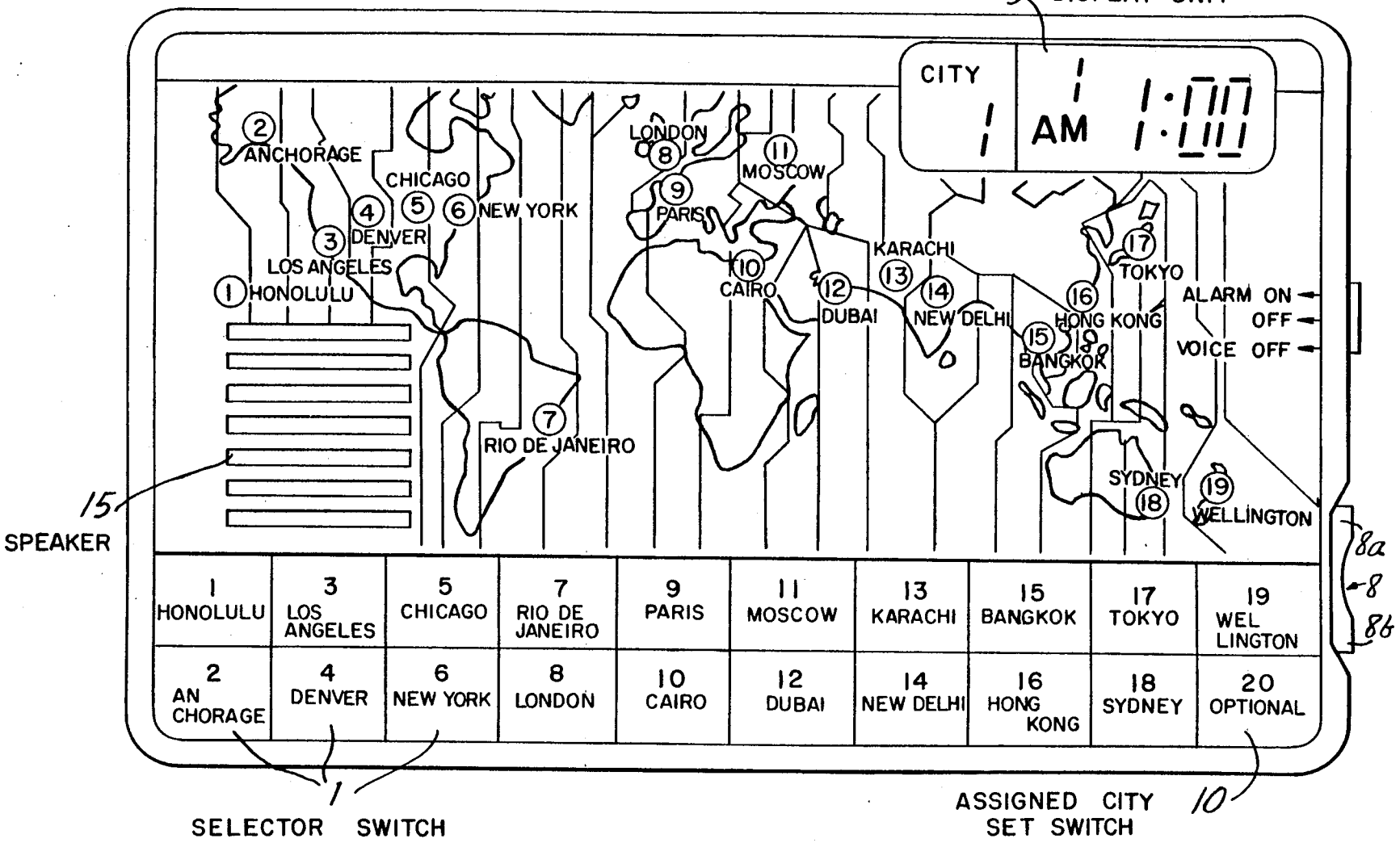
FIG. 2 is a front view exemplifying the main part of FIG. 1.

In FIG. 1, 1 denotes a selector switch provided correspondingly to a specific zone out of a plurality of time-lag zones into which the world is divided accordingly. As shown in FIG. 2 the world is divided into 30 zones, of which 19 zones have and exclusive selector switch provided therefore. A reference numeral 2 denotes a timekeeping circuit for keeping the time of a reference city, which is specified by London in the example. A reference numeral 3 denotes a time-lag storage circuit for storing a time-lag between the adjacent zones, 4 denotes an assigned city storage circuit for storing a desired zone out of the 30 zones as an assigned city, which stores the zone numbers in the example. A reference numeral 5 denotes a display unit for displaying date, time and city number of the aforementioned main cities and assigned cities, 6 denotes a home city storage circuit for storing a desired city out of the aforementioned main cities and assigned cities as a home city, 7 denotes a timer circuit for counting the time when a time of a city other than the home city is displayed on the display unit 5 and for generating an output when a predetermined time is counted, and 8 denotes a seesaw type set switch for adjusting the time of each main city and setting the time of the assigned city. A reference numeral 9 denotes a register for loading tentatively the zone number in which the assigned city is present, which is used for setting the assigned city. A reference numeral 10 denotes an assigned city set switch for obtaining the time of the assigned city stored in the assigned city storage circuit 4, and 11 denotes an inhibit circuit for detecting whether or not the zone number loaded in the register 9 comes within the range 1 to 30, and inhibiting it from being set outside the range. A reference numeral 12 denotes a,.control circuit, comprising a central processing unit CPU, operating on signals from the timer circuit 7, the set switch 8 and the assigned city set switch 10. A reference numeral 13 denotes an audio data storage circuit for storing audio data to inform in an audio mode the date, time and city name of the aforementioned each main city and assigned city, 14 denotes a speech synthesis circuit for generating a speech signal based on the audio data generated from the audio data storage circuit 13, and 15 denotes a speaker for generating speech an audible based on the speech signal generated from the speech synthesis circuit 14.

FIG. 2 exemplifies the selector switch 1, the display unit 5, the set switch 8, the assigned city set switch 10 and the speaker 15, wherein both the selector switch 1 and assigned city set switch 10 are touch types, the selector switch 1 having a city number and a city name noted thereon. A liquid crystal panel is used as the display unit 5.

FIG. 3 shows main city names of the 30 zones given in FIG. 2 and the time-lags between the zones. The selector switch 1 is provided for 19 zones to which a different city number is assigned to each, and an arbitrary one of the zones other than the aforementioned 19 zones may be optionally set according to the assigned city set switch 10.

The operation of the world timepiece will be described next.

Figure 4:
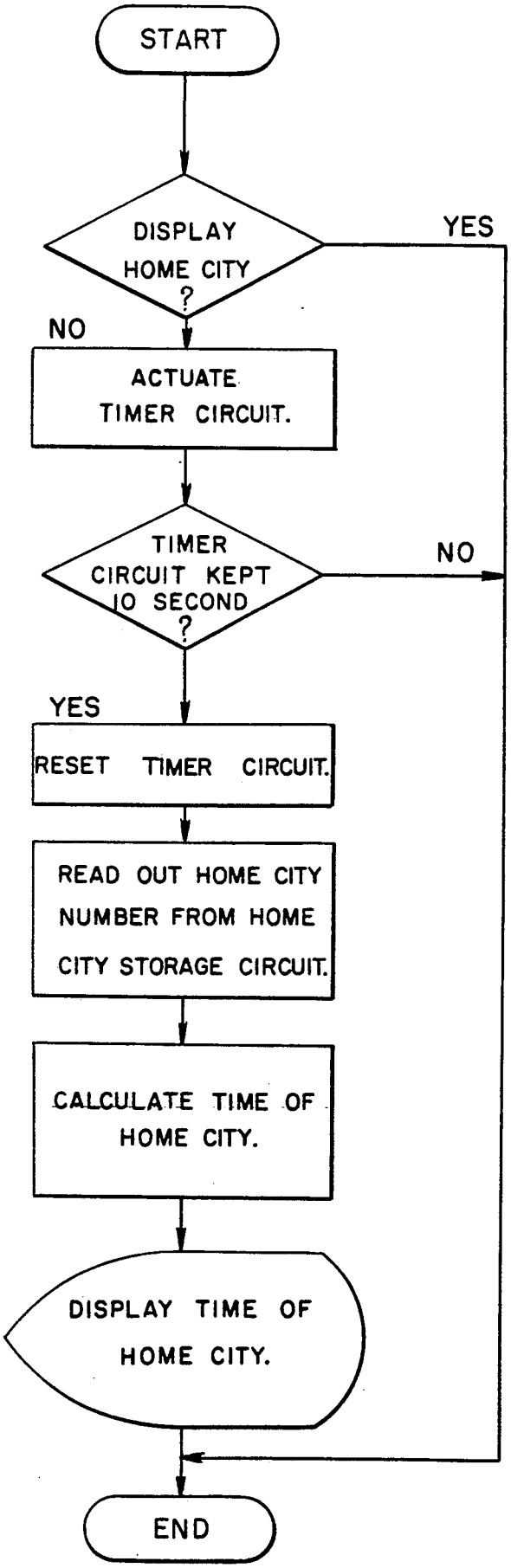
FIG. 4 and FIG. 5 are explanatory flowcharts.

First, an auto return operation for time display will be described with reference to FIG. 4. Normally, the date and time of the home city are displayed on the display unit 5. In this case, if the selector switch 1 or the assigned city set switch 10 is operated, the display on the display unit 5 is changed over to a time display of the selected one of the aforementioned main cities or assigned city other than the home city, the timer circuit 7 is actuated, and a signal is generated to the control circuit 12 when a predetermined time is kept. According to the signal from the timer circuit 7, the timer circuit 7 is reset by the control circuit 12 and the home city number is read out of the home city storage circuit 6, a time-lag corresponding to the home city number is read out of the time-lag storage circuit 3, and the date and time of the home city are calculated from the time-lag and the time kept by the timekeeping circuit 2 and then displayed on the display unit 5 together with the home city number.

According to the above operation, if the time of a city other than the home city is displayed on the display unit 5, the display is changed over to that of the home city time after a predetermined period of time.

Described next are a display of time of the assigned city and a speech informing operation.

When the assigned city set switch 10 is operated in a time adjustment unable mode, the number of the zone in which the assigned city is present is read out of the assigned city storage circuit 4 by the control circuit 12, a time-lag corresponding to the number is read out of the time-lag storage circuit 3, and the date and time of the assigned city are calculated from the time-lag and the time of reference city kept by the timekeeping circuit 2 and displayed on the display unit 5 together with the number "20" designating the assigned city number. A signal is fed also to the audio data storage circuit 13 from the control circuit 12 at the same time audio data representative of the date and time of the assigned city is generated, a speech signal is generated from the speech synthesis circuit 14 based on the audio data, and the speaker 15 produces an audible speech informing of the date and time of the assigned city according to the speech signal. For example, the audio information contained in the audible speech may be that "date and time of the assigned city are first day and 1 p.m."

Figure 5:
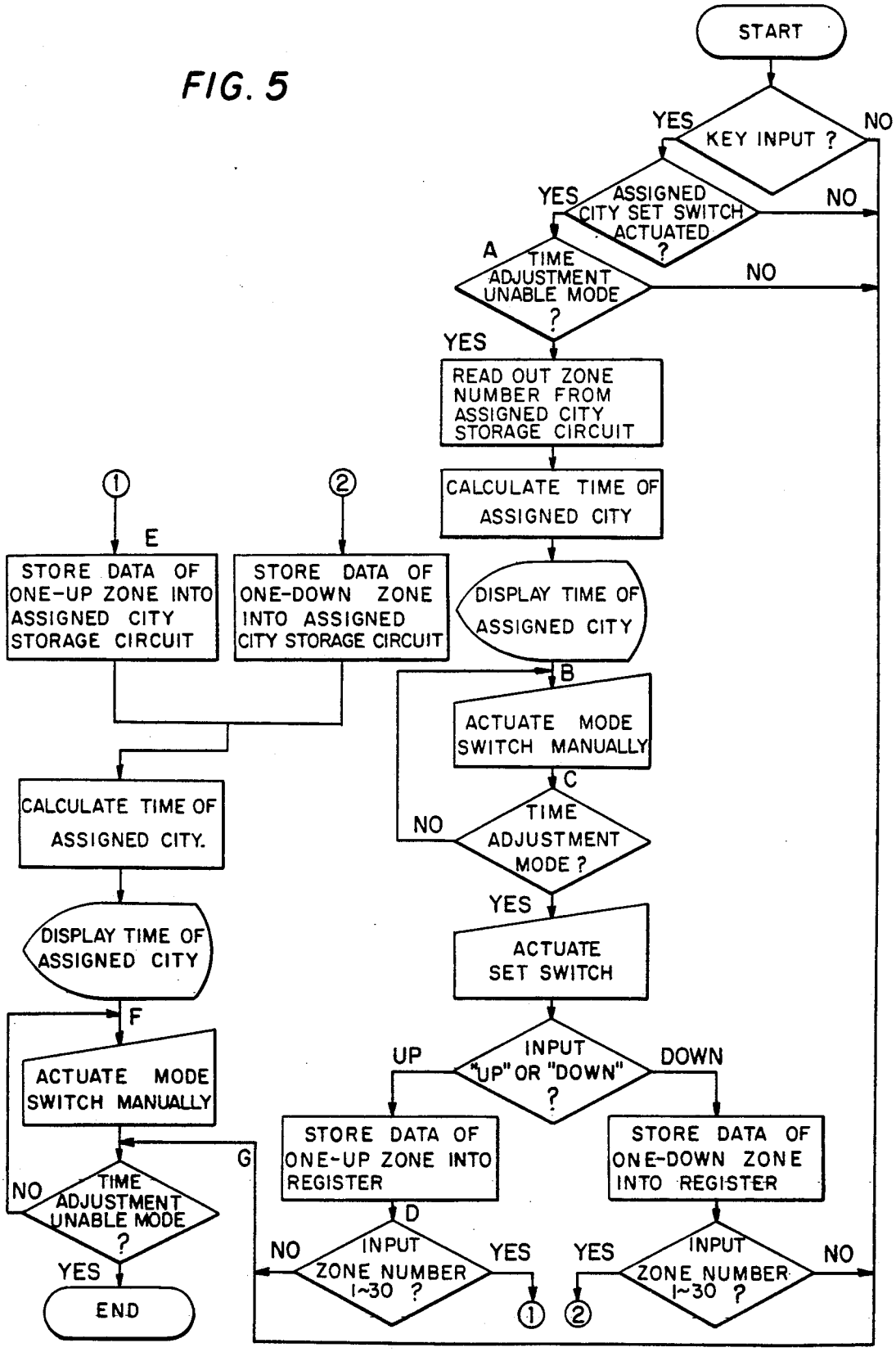

The description of a setting operation of the assigned city will now be given with reference to FIG. 4 and FIG. 5.

First in the time adjustment unable mode, the assigned city set switch 10 is operated (routine A) to display the time of the assigned city on the display unit 5 (routine B). Next, the mode is changed over to an adjustment mode of the time of the assigned city (routine C) on a mode switch (not indicated), and then by pushing, for example, an upper side operating part 8*a* of the set switch 8 one time, "1" is added to a zone number stored in the assigned city storage circuit 4 by the control circuit 12, which is written in the register 9. The inhibit circuit 11 (routine D) determines whether or not the number loaded in the register 9 comes within 1 to 30, and if it is within this range, then the number loaded in the register 9 is stored in the assigned city storage circuit 4 (routine E). The time-lag corresponding to the number stored in the assigned city storage circuit 4 is read concurrently out of the time-lag storage circuit 3 the date and time of the assigned city are calculated from the timelag and the time kept by the timekeeping circuit 2, and the date and time are displayed on the display unit 5 together with "20" of the assigned city number (routine F).

Assuming, for example, London is stored as an assigned city, and the time is 2 o'clock, if the operating part 8*a* of the set switch 8 is operated one time, then since the time-lag from the one-up zone (Paris as main city) is one hour as shown in FIG. 3, the time 1 o'clock is displayed.

By repeating the above operation, the times of the zones coming upward by one each are displayed successively, and when the mode is changed to the time adjustment unable mode on the aforementioned mode switch when the time of a desired zone is displayed, the assigned city is set to a desired zone.

In a similar manner, by pushing a lower side operating part 8*b* of the set switch 8 to get down zones in the register 9 one by one, an assigned city can be set likewise.

When the zone number in the register 9 comes outside the range of 1 to 30, that is, the range of +13 hours to −10 hours with the London time as a reference according to the above setting operation on the set switch 8, the date is changed to either the succeeding or preceding day. Consequently, when the zone number in the register 9 comes outside the range 1 to 30, the switch is not available for zone setting (routine G).

Since an arbitrary zone can be set as an option as described above, the time of a zone for which the selector switch is not particularly provided is nonetheless instantly obtainable Besides, in case, for example, the time of a city present in the same zone as New York where the daylight-saving time system is put into practice will be required so often, but the system is not under way in the city, the city can otherwise be set as assigned city.

According to the invention, since the world is divided into a plurality of time-lag zones, and the city in an arbitrary zone can be set as an option, the selector switch may be set only to a main zone, which may lead to miniaturization, lightweight structure and cost lowering and the time of an arbitrary zone may be instantly obtained.

What is claimed is:

1. A world timepiece, comprising:

actuatable selector switches corresponding respectively to main cities of desired zones out of a plurality of time-lag zones into which the world is divided, the number of said desired zones being less than the number of said time-lag zones;

an assigned city storage circuit for storing data representative of a city of an arbitrary zone selected from said time-lag zones including zones other than said desired zones as an option;

an assigned city setting circuit for setting said data into said assigned city storage circuit;

an optional switch actuatable to read out the content of said assigned city storage circuit; and a display unit for selectively displaying the time of one of said each main city or said assigned city according to the actuation of one of said selector switches or said optional switch.

2. A world timepiece according to claim 1; wherein said selector switches are fewer in number than the number of time-lag zones.

3. A world timepiece, comprising:

actuatable selector switches corresponding respectively to main cities of desired zones out of a plurality of time-lag zones into which the world is divided;

an assigned city storage circuit for storing data representative of a city of an arbitrary zone selected from said time-lag zones as an option;

an optional switch actuatable to read out the content of said assigned city storage circuit;

a home city storage circuit for storing data representative of a specific city out of said main cities as a home city;

a display unit for normally displaying the time of said home city and for temporarily displaying the time of one of said each main city or said assigned city selectively according to the actuation of one of said selector switches or said optional switch; and a timer circuit for counting a period during which the time of a city other than said home city is displayed by said display unit and generating an output after counting a desired period, thereby enabling the display unit to display the time of said home city.

4. A world timepiece according to claim 3; wherein said selector switches are fewer in number than the number of time-lag zones.

* * * * *